US008858302B2

(12) United States Patent
Kim

(10) Patent No.: US 8,858,302 B2
(45) Date of Patent: Oct. 14, 2014

(54) RETAINER RINGS OF CHEMICAL MECHANICAL POLISHING APPARATUS AND METHODS OF MANUFACTURING THE SAME

(75) Inventor: Choon-Goang Kim, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 241 days.

(21) Appl. No.: 13/478,353

(22) Filed: May 23, 2012

(65) Prior Publication Data

US 2012/0309276 A1 Dec. 6, 2012

(30) Foreign Application Priority Data

May 31, 2011 (KR) ..... 10-2011-0051944

(51) Int. Cl.
*B24B 37/32* (2012.01)

(52) U.S. Cl.
CPC ..... *B24B 37/32* (2013.01)
USPC ..... 451/364; 451/398; 451/285; 451/287; 451/290

(58) Field of Classification Search
CPC ..... B24B 7/228; B24B 57/02; B24B 57/04
USPC ..... 451/41, 285–290, 398, 364
See application file for complete search history.

(56) References Cited

U.S. PATENT DOCUMENTS

| | | | | |
|---|---|---|---|---|
| 5,597,346 | A * | 1/1997 | Hempel, Jr. | 451/287 |
| 5,643,061 | A * | 7/1997 | Jackson et al. | 451/289 |
| 6,224,472 | B1 * | 5/2001 | Lai et al. | 451/398 |
| 6,454,637 | B1 * | 9/2002 | Gotkis | 451/287 |
| 6,962,520 | B2 * | 11/2005 | Taylor | 451/41 |
| 7,118,456 | B2 * | 10/2006 | Moloney et al. | 451/41 |
| 7,131,892 | B2 * | 11/2006 | Fuhriman et al. | 451/41 |
| 7,326,105 | B2 * | 2/2008 | Chandrasekaran | 451/285 |
| 7,347,767 | B2 * | 3/2008 | Chandrasekaran | 451/36 |
| 2005/0037694 | A1 * | 2/2005 | Taylor | 451/41 |
| 2007/0135027 | A1 * | 6/2007 | Chandrasekaran | 451/285 |
| 2008/0293339 | A1 * | 11/2008 | Huang et al. | 451/285 |
| 2008/0299880 | A1 * | 12/2008 | Gunji et al. | 451/385 |
| 2009/0061744 | A1 * | 3/2009 | Bajaj | 451/288 |
| 2009/0142990 | A1 * | 6/2009 | Kohama et al. | 451/6 |
| 2009/0191791 | A1 * | 7/2009 | Fukushima et al. | 451/9 |

FOREIGN PATENT DOCUMENTS

| | | | |
|---|---|---|---|
| JP | 2010-129863 | A | 6/2010 |
| KR | 10-2007-0026020 | A | 3/2007 |
| KR | 10-2008-0109119 | A | 12/2008 |

* cited by examiner

*Primary Examiner* — George Nguyen
(74) *Attorney, Agent, or Firm* — Lee & Morse, P.C.

(57) ABSTRACT

A retainer ring of a chemical mechanical polishing apparatus includes a base portion having a ring shape, the base portion including a pressurizing surface and a combining surface opposite the pressurizing surface, slurry inflowing portions on the pressurizing surface of the base portion, the slurry inflowing portions having groove shapes, and minute grooves at least on a surface portion of the slurry inflowing portions.

18 Claims, 8 Drawing Sheets

RETAINER RINGS OF CHEMICAL MECHANICAL POLISHING APPARATUS AND METHODS OF MANUFACTURING THE SAME

CROSS-REFERENCE TO RELATED APPLICATIONS AND CLAIM OF PRIORITY

This application claims priority under 35 U.S.C. §119 to Korean Patent Application No. 10-2011-0051944, filed on May 31, 2011 in the Korean Intellectual Property Office, the contents of which are incorporated herein by reference in its entirety.

BACKGROUND

1. Field

The inventive concept relates to retainer rings of a chemical mechanical polishing apparatus and methods of manufacturing the same. More particularly, the inventive concept relates to retainer rings of a chemical mechanical polishing apparatus for polishing a substrate and methods of manufacturing the same.

2. Description of the Related Art

In a method of manufacturing a semiconductor device, a chemical mechanical polishing (CMP) process may be performed using a CMP apparatus to planarize a surface portion of an insulating layer formed on a substrate or to selectively remove a conductive layer formed on the substrate. In the CMP apparatus, a retainer ring may be provided for supporting a side portion of the substrate to prevent a separation of the substrate from a platen including a polishing pad. A slurry may be used as a polishing agent to perform the polishing process.

SUMMARY

Some embodiments provide retainer rings of a chemical mechanical polishing apparatus in which contamination due to slurry may be prevented.

Some embodiments also provide methods of manufacturing the above-described retainer rings of the chemical mechanical polishing apparatus.

Some embodiments may provide a retainer ring of a chemical mechanical polishing apparatus, including a base portion having a ring shape, the base portion including a pressurizing surface and a combining surface opposite the pressurizing surface, slurry inflowing portions on the pressurizing surface of the base portion, the slurry inflowing portions having groove shapes, and minute grooves at least on a surface portion of the slurry inflowing portions.

A width of each minute groove may be smaller than ten times of a diameter of a maximum-size particle included in a slurry and may be greater than a diameter of a water molecule.

The width of each minute groove may be smaller than the diameter of the maximum-size particle included in the slurry.

The minute grooves may be arranged in parallel to each other, the minute grooves having line shapes extending from an outer circumference to an inner circumference of the base portion.

A distance between the minute grooves may be smaller than ten times a diameter of a maximum-size particle included in a slurry.

The distance between adjacent minute grooves may be smaller than the diameter of the maximum-size particle included in the slurry.

The slurry inflowing portions may be disposed at a same distance along the base portion, the slurry inflowing portions having line shapes extending from an outer circumference to an inner circumference of the base portion.

The minute grooves may be on a surface portion of the pressurizing surface between adjacent slurry inflowing portions.

The minute grooves may be on a bottom portion and on a sidewall portion of the slurry inflowing portion of the base portion.

The minute grooves may be only on a bottom portion of the slurry inflowing portion of the base portion.

The base portion may include engineering plastic.

Some embodiments may also provide a retainer ring of a chemical mechanical polishing apparatus, including a base portion including a first surface and a second surface opposite each other, slurry inflowing portions on the first surface of the base portion, the slurry inflowing portions being recesses in the first surface and being configured to pass slurry therethrough, and a plurality of minute grooves on at least a portion of each slurry inflowing portion, each minute groove having a same length as a corresponding slurry inflowing portion and a smaller width than the corresponding slurry inflowing portion.

A width of each minute groove may be smaller than a maximum particle diameter in the slurry, the width of the minute groove being measured along a perimeter of the base portion.

A depth of each minute groove may be smaller than a corresponding minute groove width.

Some embodiments may also provide a method of manufacturing a retainer ring, including forming a base portion having a ring shape, the base portion including a pressurizing surface and a combining surface opposite the pressurizing surface, forming slurry inflowing portions on the pressurizing surface of the base portion, the slurry inflowing portions having groove shapes, and forming minute grooves at least on a surface portion of the slurry inflowing portions.

Forming the base portion may include forming a preliminary base portion having a ring shape by cutting and processing an engineering plastic, and cutting and processing a surface portion of the preliminary base portion to form the base portion.

Forming the slurry inflowing portions may include removing a portion of the pressurizing surface of the base portion.

Forming the minute grooves may include forming a width of the minute grooves to be smaller than ten times of a diameter of a maximum-size particle included in a slurry and to be greater than a diameter of a water molecule.

Forming the minute grooves may include forming a distance between the minute grooves to be smaller than ten times of a diameter of a maximum-size particle included in the slurry.

Forming the minute grooves may include performing a mechanical processing or a photolithography on the base portion.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
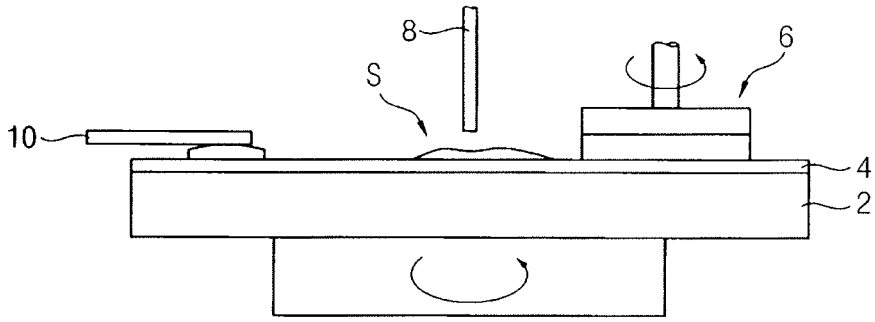
FIG. 1 illustrates a schematic cross-sectional view of a CMP apparatus including a retainer ring in accordance with exemplary embodiments.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when an element, e.g., a layer, is referred to as being "on" another layer or substrate, it can be directly on the other layer or substrate, or intervening layers may also be present. In addition, it will also be understood that when a layer is referred to as being "between" two layers, it can be the only layer between the two layers, or one or more intervening layers may also be present. Further, when a layer is referred to as being "connected to" or "coupled to" another layer, it can be directly connected or coupled to the other layer, or intervening layers may also be present. In contrast, when an element is referred to as being "directly on," "directly connected to," or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concept.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments are described herein with reference to cross-sectional illustrations that are schematic illustrations of idealized exemplary embodiments (and intermediate structures). As such, variations from the shapes of the illustrations as a result, for example, of manufacturing techniques and/or tolerances, are to be expected. Thus, exemplary embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the present inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Hereinafter, exemplary embodiments of retainer rings of a CMP apparatus and methods of manufacturing the same will be explained in detail.

First Embodiment

Figure 2:
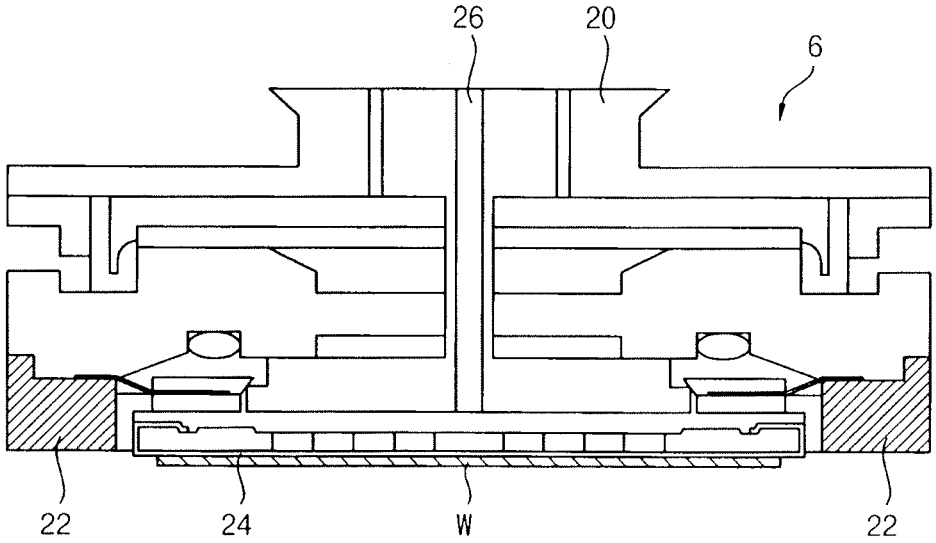
FIG. 2 illustrates an enlarged cross-sectional view of a polishing head portion in the CMP apparatus illustrated in FIG. 1.
Figure 3:
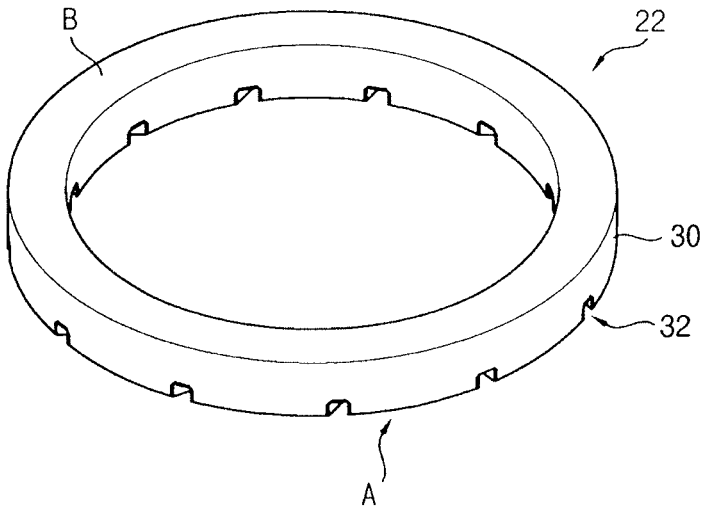
FIG. 3 illustrates a perspective view of the retainer ring in the CMP apparatus illustrated in FIG. 1.
Figure 4:
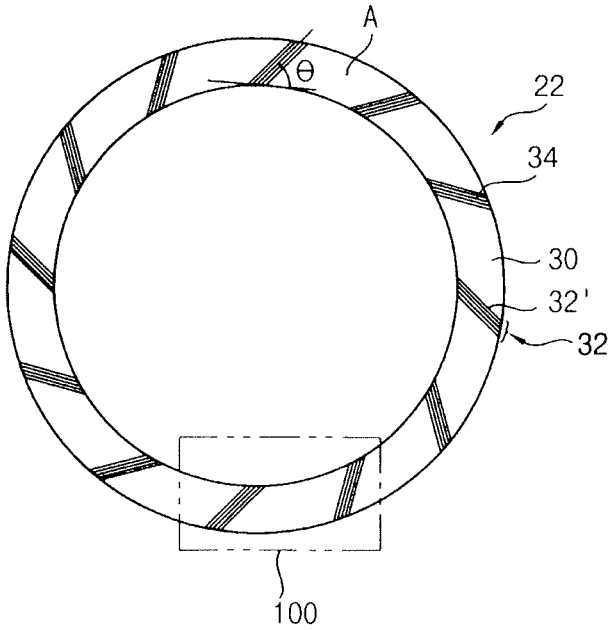
FIG. 4 illustrates a plan view of a pressurizing surface in the retainer ring illustrated in FIG. 3.
Figure 5:
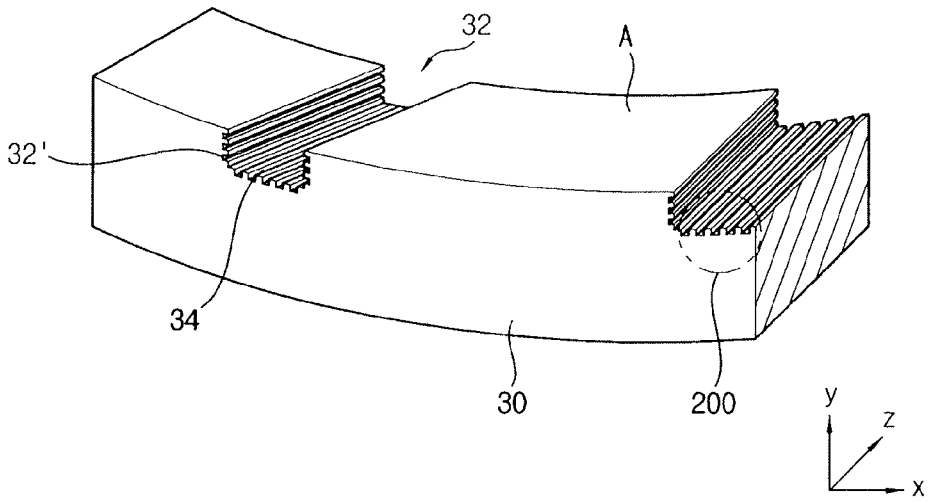
FIG. 5 illustrates an enlarged partial view of the retainer ring illustrated in FIG. 3.

FIG. 1 is a cross-sectional view of a schematic diagram of a CMP apparatus including a retainer ring in accordance with exemplary embodiments. FIG. 2 is a cross-sectional view of a polishing head portion in the CMP apparatus illustrated in FIG. 1. FIG. 3 is a perspective view of the retainer ring in the CMP apparatus illustrated in FIG. 1. FIG. 4 is a plan view of a pressurizing surface in the retainer ring illustrated in FIG. 3. FIG. 5 is an enlarged partial view of the retainer ring illustrated in FIG. 3.

The CMP apparatus described herein below may include commonly applied components except for the retainer ring.

Referring to FIG. 1, a CMP apparatus may be provided with a rotatable platen 2. On an upper surface portion of the platen 2, a polishing pad 4 may be attached. A polishing head 6 facing the polishing pad 4 may be provided. A slurry supplying nozzle 8 for supplying a slurry S onto a substrate may be provided. In addition, a dresser 10 for keeping a desired surface state of the polishing pad 4 may be provided. The polishing head 6 may contact the polishing pad 4 while supporting the substrate and pressurizing the substrate. The polishing head 6 may move on the polishing pad 4.

Referring to FIG. 2, The polishing head 6 may include a head body 20, a retainer ring 22 installed at an edge portion of the head body 20, and a membrane layer 24 provided in the retainer ring 22 and on a backside of the head body 20. The membrane layer 24 may pressurize a backside of a polishing surface of a substrate W. Within the head body 20, an inner tube 26 may be provided and an air for pressurizing may inflow through the inner tube 26 to the membrane layer 24. The retainer ring 22 may function to prevent a separation of the substrate W from the polishing head 6.

A polishing process using the CMP apparatus will be described briefly hereinafter. The platen 2 may start spinning to rotate the polishing pad 4. The slurry S and water may be supplied through the slurry supplying nozzle 8 to the polishing pad 4 to perform a CMP process. The substrate W to be polished may be loaded on the polishing pad 4. The polishing head 6 may pressurize the substrate W to apply a required pressure for polishing the substrate W while performing the polishing process. The substrate W may be loaded by a moving operation of the polishing head 6.

After performing the polishing process with respect to a layer formed on the substrate W, a cleaning process may be performed to remove remaining slurry S from the substrate W, the polishing pad 4, and the retainer ring 22. Through the cleaning process, most of the slurry S attached to the substrate W may be removed. In order to perform the cleaning process with respect to the polishing pad 4 and the retainer ring 22, a cleaning solution, e.g., pure water or de-ionized water, may be supplied onto the polishing pad 4, while rotating the polishing pad 4. The cleaning solution used for performing the cleaning process may be supplied through a separate cleaning solution supplying nozzle (not illustrated) or through the slurry supplying nozzle 8 in place of the slurry.

When slurry S, e.g., slurry residue, used for polishing the layer to be polished on the substrate W remains on the polishing pad 4 or the retainer ring 22, the slurry residue may contact a surface portion of a layer to be polished and may become a factor generating scratches on a surface portion of the layer to be polished while performing a subsequent polishing process. Accordingly, the cleaning process may be required to completely remove the remaining slurry from the polishing pad 4 and the retainer ring 22, after performing the polishing process with respect to the substrate W, to complete the CMP process.

Hereinafter, explanation of the retainer ring may be given in detail referring to FIGS. 3 to 5.

Referring to FIGS. 3 and 4, the retainer ring 22 may be formed using engineering plastics. Example materials for forming the engineering plastics may include polytetrafluoroethylene (PTFE), polyether ether ketone (PEEK), polyphenylene sulfide (PPS), polyethylene terephthalate (PET), polyethylene, polyamide, polyacetal, polyimide, polyamide-imide, etc. In exemplary embodiments, the retainer ring 22 may be formed using PPS, which has a strong hardness when considering a chemical-resistance, a mechanical property, etc.

The retainer ring 22 may include a base portion 30 having a ring shape and surrounding a sidewall edge portion of a substrate. As illustrated in FIG. 3, the base portion 30 may include a pressurizing surface A for contacting the polishing pad 4 and a combining surface B to be installed onto the polishing head 6. The combining surface B may be opposite the pressurizing surface A, and may be combined with the polishing head 6 using a screw.

Slurry inflowing portions 32, e.g., having a groove shape, for inflowing the slurry to the substrate and discharging the slurry may be provided at the pressurizing surface A. For example, the slurry inflowing portions 32 may be indents recessed to a predetermined depth from the pressurizing surface A toward the combining surface B, e.g., the recessed indents may be spaced apart from each other and along a perimeter of the base portion 30. For example, as illustrated in FIG. 4, each indent may have a line shaped groove extending from an outer circumference to an inner circumference of the retainer ring 22, e.g., to allow fluid communication between the outer circumference to the inner circumference of the retainer ring 22. Both sidewalls 32' of the slurry inflowing portions 32 may be oriented to make a predetermined angle θ, e.g., about 30° to about 55°, with a tangential line of an inner circle of the base portion 30. For example, two sidewalls 32' of each slurry inflowing portion 32 may be parallel to each other to define a same angle with the tangential line of the inner circle of the base portion 30, and two adjacent slurry inflowing portions 32 may be oriented at the same tangential angle with respect to the tangential line of the inner circle of the base portion 30.

A plurality of the slurry inflowing portions 32 may be provided while keeping regular separation to each other at the pressurizing surface A of the base portion 30 in order to uniformly supply the slurry through the slurry inflowing portions 32 onto the whole surface portion of the substrate.

Minute grooves 34 may be formed at the surface portions of the slurry inflowing portions 32. The minute grooves 34 may be formed at the sidewalls 32' and the bottom portion of the slurry inflowing portions 32. The minute grooves 34 will be explained in more detail with reference to FIGS. 5 and 6.

FIG. 5 illustrates an enlarged portion 100 of the retainer ring 22 (FIG. 4). Referring to FIG. 5, the minute grooves 34 may be formed in parallel and at a certain distance from each other. For example, one slurry inflowing portion 32 recessed into the base portion 30 may include a plurality of the minute grooves 34, e.g., an entire surface of the slurry inflowing portion 32 may be covered by a plurality of minute grooves 34 recessed into the base portion 30 and spaced apart from each other. The minute grooves 34 may have a line shape directed from the outer circumference to the inner circumference of the base portion 30. For example, a length of each minute groove 34 along the z-axis may substantially equal a length of each slurry inflowing portion 32 along the z-axis and a width of the base portion 30 along the z-axis. For example, a width of one minute groove 34 along the x-axis may be substantially smaller than a width of the slurry inflowing portion 32 along the x-axis, e.g., a width of the slurry inflowing portion 32 may be at least ten times larger than a width of one minute groove 34. The width and depth of the minute grooves 34 may be adjusted to prevent attachment of the slurry onto the surface portions of the pressurizing surface A and the slurry inflowing portions 32, as will be explained in more detail below with reference to FIG. 6. It is further noted that while the x-axis is used to indicate direction for measuring widths of the slurry inflowing portion 32 and the minute grooves 34 in FIG. 5, the widths of the slurry inflowing portion 32 and the minute grooves 34 extend approximately along a tangential direction, i.e., along a same direction as a perimeter of the retainer ring 22.

Figure 6:
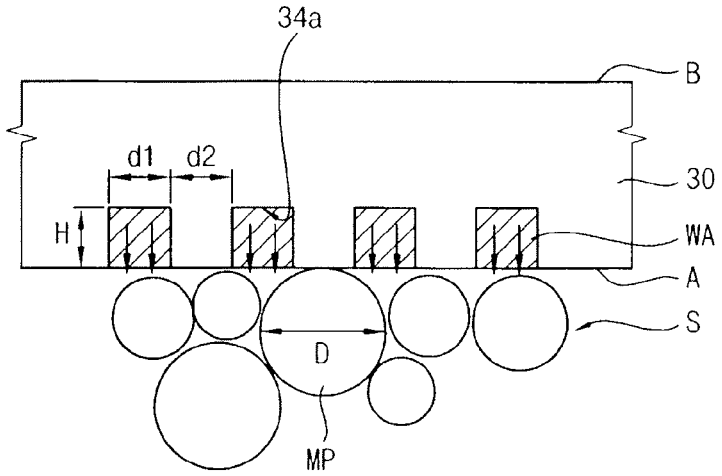
FIG. 6 illustrates a cross-sectional view for explaining behavior of particles in a slurry flowing into the retainer ring while performing a CMP process.

FIG. 6 is a cross-sectional view for explaining behavior of particles in a slurry inflowing into the retainer ring 22 while performing a CMP process. FIG. 6 is an enlarged view of portion 200 in FIG. 5. The pressurizing surface A of the retainer ring 22 may face downward, i.e., toward the wafer W, while performing a polishing process.

Referring to FIG. 6, water WA may inflow onto the substrate along with the slurry S while performing the polishing process. After completing the polishing process, water WA may inflow continuously onto the polishing pad 4, while performing a cleaning process with respect to the polishing pad 4 and the retainer ring 22. Accordingly, water WA supplied while performing the polishing process and the cleaning process may move through an inner passage of the minute grooves 34. That is, the minute grooves 34 may keep a filled state with water WA, while performing the polishing process and the cleaning process, and water WA may keep flowing to the substrate loaded on the polishing head 6.

As the minute grooves 34 may be continuously filled with flowing water WA, the water WA flowing along the minute grooves 34 may apply a vertical force to the slurry S with respect to the surface of the slurry inflowing portions 32, so that the slurry S may not attach onto the surface of the slurry inflowing portions 32, e.g., onto the surface of the minute grooves 34 that are filled with water. Accordingly, the slurry S may not contact the surface of the slurry inflowing portions 32, e.g., the surface of the minute grooves 34, but may float above the water WA.

Further, even if a portion of the slurry S attaches to the surface of the slurry inflowing portions 32, the attached slurry may be removed while performing the cleaning process with respect to the polishing pad 4 and the retainer ring 22 because water WA may be provided through the minute grooves 34 continuously after completing the polishing process. Accordingly, generation of scratch defects on the surface portion of the substrate, while performing the CMP process due to the attached slurry on the surface of the slurry inflowing portions 32, may be decreased.

In addition, the depth and width of the minute grooves 34 may be adjusted to further prevent attachment of the slurry S to the surface of the slurry inflowing portions 32. That is, if an inner width of a minute groove is greater than a maximum diameter D of a maximum particle MP, i.e., a particle having a maximum size, included in the slurry S, the particles in the slurry S may be caught in the minute grooves. Therefore, a width d1 of the minute grooves 34 according to example embodiments may be adjusted to be smaller than the maximum diameter D of the maximum particle MP in the slurry S. As such, particles of the slurry S may not be caught in the minute grooves 34. In addition, the width d1 of the minute grooves 34 may be greater than a diameter of water molecules since the minute grooves 34 may be a passage of flowing water WA.

Even when the inner width d1 of the minute grooves 34 is greater than the maximum diameter D of the maximum particle MP, the slurry particles may float on the flowing water WA through the minute grooves 34. In this case, the attachment of the slurry onto the surface of the slurry inflowing portion 32 and solidification of the attached slurry may be decreased. Therefore, the width d1 of the minute grooves 34 may be controlled to be smaller than or greater than the maximum diameter D of the maximum particle MP in the slurry S.

For example, the width d1 of the minute grooves 34 may be smaller than ten times of the maximum diameter of the maximum particle MP in the slurry S. For example, when the diameter of the maximum particle MP in the slurry S is about 130 nm, the width d1 of each of the minute grooves 34 may be smaller than about 1,300 nm. For example, the width d1 of each of the minute grooves 34 may be smaller than about 130 nm, so that the particles included in the slurry S may not be easily caught into the minute grooves 34.

When a distance d2 between the minute grooves 34 is greater than the maximum diameter D of the maximum particle MP included in the slurry S, the particles of the slurry S may attach onto the planar surface portion between the minute grooves 34. Accordingly, the distance d2 between the minute grooves 34 may be preferably smaller than the maximum diameter D of the maximum particle MP in the slurry S.

Even when the separating distance d2 between the minute grooves 34 is greater than the maximum diameter D of the maximum particle MP in the slurry S, the slurry S may float on the flowing water WA along the minute grooves 34. Accordingly, attachment of the slurry S onto the surface of the slurry inflowing portion 32 may be decreased to some degree. Therefore, the distance d2 between the minute grooves 34 may be controlled to be smaller than or greater than the maximum diameter D of the maximum particle MP in the slurry S.

Particularly, the distance d2 between the minute grooves 34 may be smaller than ten times of the maximum diameter D of the maximum particle MP in the slurry S. When the maximum diameter D is about 130 nm, the distance d2 between the minute grooves 34 may be smaller than about 1,300 nm. Particularly, the separating distance d2 between the minute grooves 34 may be smaller than about 130 nm in order to prevent attachment of the slurry particles onto the planar surface between the minute grooves 34.

When a depth H of the minute grooves 34 is large, the minute grooves 34 may not be sufficiently filled up with the water. Accordingly, the inner depth H of the minute grooves 34 may be smaller than the inner width d1 of the minute grooves 34.

Figure 7:
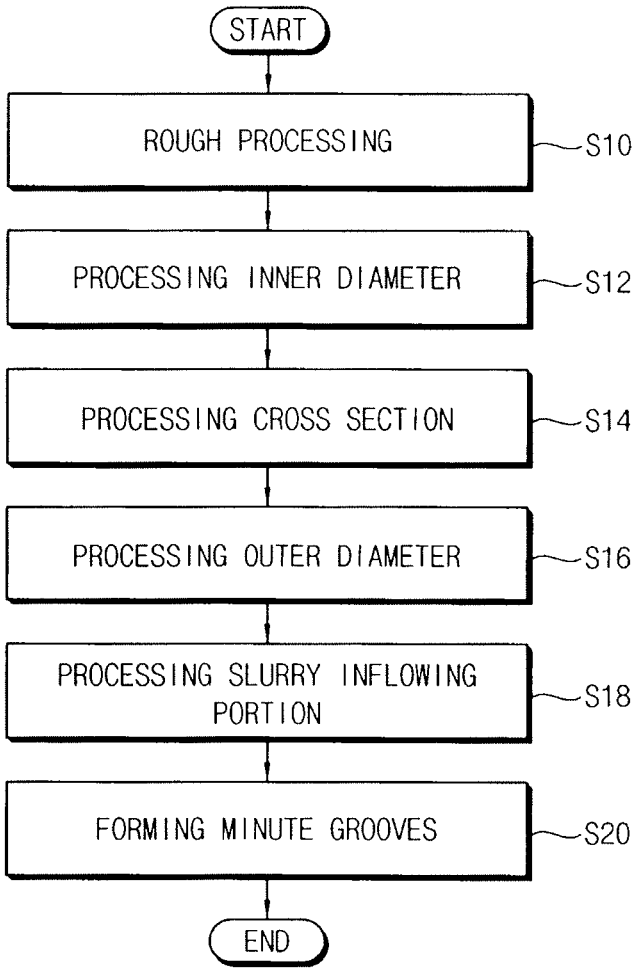
FIG. 7 illustrates a flow chart of a manufacturing method of a retainer ring in accordance with exemplary embodiments.

FIG. 7 is a flow chart of a manufacturing method of a retainer ring in accordance with exemplary embodiments.

Referring to FIG. 7, an engineering plastic material may be roughly cut and processed to obtain a ring shape similar to a finally obtained retainer ring. The ring shape may have nearly the same size as the retainer ring designed to be manufactured (Step S10). For example, PPS material may be used as a molding resin having a strong hardness.

The ring may be cut and processed to have a desired and designed inner diameter (Step S12).

Then, the ring may be cut and processed to form a pressurizing surface A and a combining surface B having desired and designed measures (Step S14).

The ring may be cut and processed to have a desired and designed outer diameter (Step S16).

In addition, the pressurizing surface A may be processed to form a slurry inflowing portion 32 (Step S18).

Surface portions of the pressurizing surface A and the slurry inflowing portion 32 may be processed to form minute grooves 34 (Step S20).

As described above, the width d1 of the minute grooves 34 may be smaller than the maximum diameter D of the maximum particle MP. For example, the width d1 of the minute grooves 34 may be smaller than ten times of the maximum diameter D of the maximum particle MP included in the slurry S.

Also, the separating distance d2 between adjacent minute grooves 34 may be smaller than the maximum diameter D of the maximum particle MP. For example, the separating distance d2 between the minute grooves 34 may be smaller than ten times of the maximum diameter D of the maximum particle MP in the slurry S. Further, the inner depth H of the minute grooves 34 may be smaller than the inner width d1 of the minute grooves 34.

When the width and the distance of the minute grooves 34, i.e., d1 and d2, are greater than about 200 nm, the minute grooves 34 may be formed by performing a mechanical processing. However, when the width and the distance of the minute grooves 34 are smaller than about 200 nm, the minute grooves 34 may not be formed by the mechanical processing. The minute grooves having the width and the distance smaller than about 200 nm may be formed by performing a photolithography process.

For example, a photoresist layer may be coated on the surface of the pressurizing surface A including the slurry inflowing portion 32. The photoresist layer may be exposed and developed to form photoresist patterns. The photoresist patterns may selectively expose some portions of the pressurizing surface A for forming the minute grooves 34. The exposed portion may be etched using the photoresist patterns as an etching mask to form the minute grooves 34.

As described above, the retainer ring including the slurry inflowing portions 32 having the minute grooves 34 formed thereon may be manufactured by performing the mechanical processing or the photolithography process.

Second Embodiment

Figure 8:
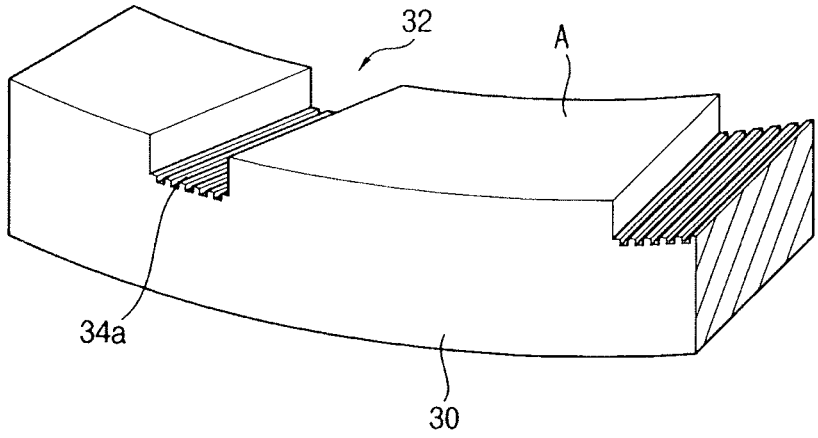
FIG. 8 illustrates an enlarged partial view of a retainer ring in accordance with other exemplary embodiments.

FIG. 8 is an enlarged partial view of a retainer ring in accordance with other exemplary embodiments.

The retainer ring in the second embodiment may include the same components described previously with reference to the first embodiment, i.e., with reference to FIGS. 1-6, except for a portion including minute grooves in the retainer. That is, the base portion 30 in FIG. 8 may include minute grooves 34*a* that are formed only on a bottom portion of the slurry inflowing portion 32, so a sidewall of the slurry inflowing portion 32 may not include the minute grooves 34*a*.

The minute grooves 34*a* may be provided in parallel with a certain distance from each other. The minute grooves 34*a* may have a line shape directed from the outer circumference to the inner circumference of the base portion 30. The width and depth of the minute grooves 34*a* and the distance between the minute grooves 34*a* may be the same as described with reference to the minute grooves 34 in the first embodiment.

The retainer ring in accordance with the second embodiment may be formed by performing almost the same processes described above with reference to FIG. 7, with the exception of forming the minute grooves 34*a* only on the bottom portion of the slurry inflowing portions 32 while performing the forming process of the minute grooves 34*a*. When the minute grooves 34*a* are formed by the mechanical processing, the mechanical processing may be applied only to the bottom portion of the slurry inflowing portion 32. When the minute grooves 34*a* are formed by the photolithography process, the photoresist patterns are formed so that the minute grooves 34*a* may be formed only on the bottom portion of the slurry inflowing portion 32.

Third Embodiment

Figure 9:
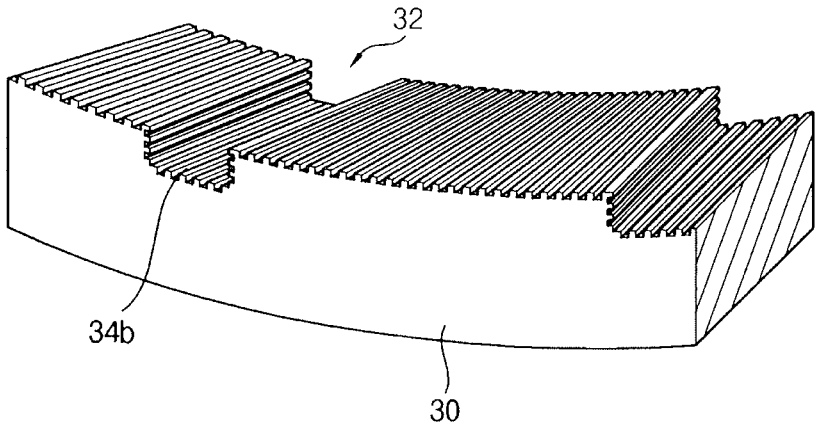
FIG. 9 illustrates an enlarged partial view of a retainer ring in accordance with other exemplary embodiments.

FIG. 9 is an enlarged partial view of a retainer ring in accordance with other exemplary embodiments. Referring to FIG. 9, the retainer ring may include the same components as described previously with reference to the first embodiment, except for the portion including minute grooves in the retainer ring.

In detail, the retainer ring in FIG. 9 may include minute grooves 34*b* on the surface of the pressurizing surface A and on the surface of the slurry inflowing portion 32. For example, the minute grooves 34*b* may overlap the entire pressurizing surface A, i.e., may be on the bottom and sidewalls of the slurry inflowing portion 32 and on an entire flat portion of the pressurizing surface A between adjacent slurry inflowing portions 32. The minute grooves 34*b* may be provided in parallel with a constant distance from each other. The minute grooves 34*b* may have a line shape extending from the outer circumference to the inner circumference and extending in a perpendicular direction to a sidewall of the retainer ring 22. The width and the depth of the minute grooves 34*b* and the distance between the minute grooves 34*b* may be the same as described with reference to the first embodiment.

The retainer ring 22 may include the minute grooves 34*b* formed on the surface portion of the pressurizing surface A along with the slurry inflowing portion 32. Accordingly, contamination of the retainer ring 22 by the slurry may be prevented even further.

The retainer ring in accordance with the third embodiment may be manufactured by similar processes as described above referring to FIG. 7. However, the minute grooves 34*b* may be formed on the surface portion of the pressurized surface A along with the slurry inflowing portion 32 while performing the forming process of the minute grooves 34*b*. When the minute grooves 34*b* are formed by performing the mechanical processing, the mechanical processing may be applied to the surface portion of the pressurizing surface A along with the surface portion of the slurry inflowing portion 32. When the minute grooves 34*b* are formed by the photolithography process, the photoresist patterns may be formed so that the minute grooves 34*b* may be formed on the surface portion of the pressurizing surface A along with the surface portion of the slurry inflowing portion 32.

Hereinafter, contamination degree of a retainer ring by slurry while performing a CMP process using a CMP apparatus in accordance with exemplary embodiments will be compared to a contamination degree of a retainer ring by slurry while performing a CMP process using a conventional CMP apparatus, i.e., a CMP apparatus having a retainer ring without the minute grooves in the slurry inflowing portion.

Figure 10:
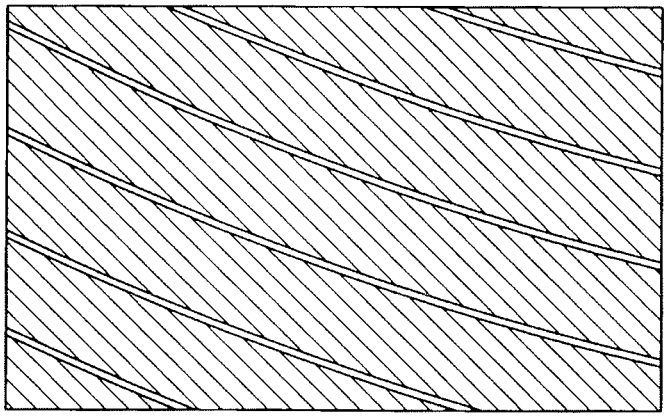
FIG. 10 illustrates a schematic drawing figure of a photographic image of a surface portion of a slurry inflowing portion in a retainer ring in Sample #1.

Sample #1:

A retainer ring including minute grooves according to example embodiments was formed. FIG. 10 is a schematic drawing figure of a photographic image of a slurry inflowing portion in a retainer ring of Sample #1. FIG. 10 is an enlarged figure.

Referring to FIG. 10, minute grooves were formed on surface portions of the pressurizing surface and the slurry inflowing portion. The minute grooves were formed by performing a mechanical processing. The minute grooves had a width of about 200 nm, a depth of about 50 nm, and a distance of about 800 nm therebetween.

Figure 11:
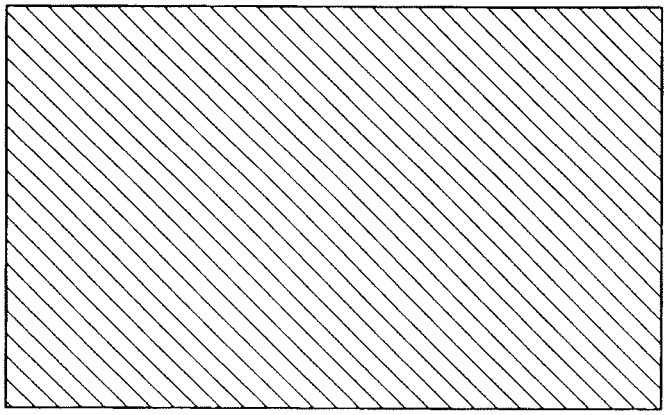
FIG. 11 illustrates a schematic drawing figure of a photographic image of a surface portion of a slurry inflowing portion in a retainer ring in Comparative Sample #1.

Comparative Sample #1:

A retainer ring including planar surface portions of a pressurizing surface was manufactured. The retainer ring of the Comparative Sample #1 did not include minute grooves on the surface portions of the pressurizing surface or on the slurry inflowing portion. FIG. 11 is a schematic drawing figure of a photographic image of a surface portion of a slurry inflowing portion in a retainer ring in Comparative Sample #1. FIG. 11 is an enlarged figure. Referring to FIG. 11, the surface of the slurry inflowing portion may have a planar shape and may not include minute grooves.

Comparative Experiment #1:

Each of the retainer rings of Sample #1 and Comparative Sample #1 was installed onto a CMP apparatus. Then, a CMP process with respect to a substrate was performed using slurry including a maximum particle diameter of about 130 nm.

Figure 12:
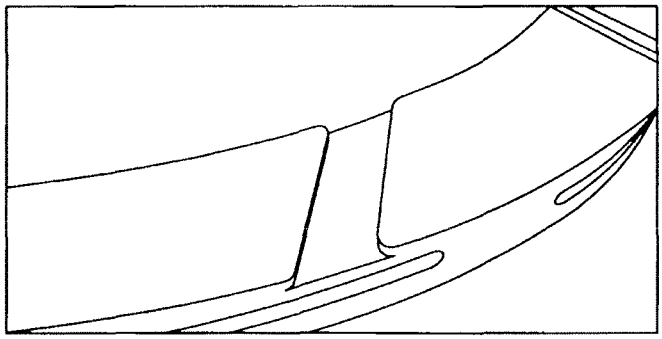
FIG. 12 illustrates a schematic drawing figure of a photographic image of a retainer ring in accordance with Sample #1 installed onto a CMP apparatus, after performing a polishing process for about 170 hours.

FIG. 12 is a schematic drawing figure of a photographic image of the retainer ring of Sample #1 installed onto a CMP apparatus after performing a polishing process for about 170 hours. Referring to FIG. 12, no contamination due to the slurry was observed on the retainer ring of Sample #1 even after performing the CMP process for a long time.

Figure 13:
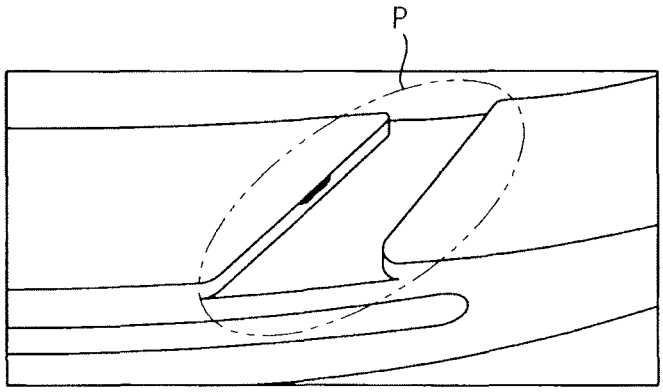
FIG. 13 illustrates a schematic drawing figure of a photographic image of a retainer ring in accordance with Comparative Sample #1 installed onto a CMP apparatus, after performing a polishing process for about 17 hours.

FIG. 13 is a schematic drawing figure of a photographic image of the retainer ring of Comparative Sample #1 installed onto a CMP apparatus after performing a polishing process for about 17 hours. Referring to FIG. 13, contamination P due to the slurry was observed on the surface portion of the slurry inflowing portion of the retainer ring of Comparative Sample #1 even after performing the CMP process for a short time of about 17 hours.

Therefore, as seen in the experiments, contamination of the retainer ring due to the slurry may be prevented or substantially minimized when the retainer ring includes minute grooves in accordance with exemplary embodiments. In contrast, when a portion of slurry attaches onto the conventional retainer ring and is solidified, the solidified slurry may be subsequently introduced onto a substrate to generate scratch defects on the surface portion of the substrate. In exemplary embodiments, the attaching of the slurry onto the retainer ring may be decreased, thereby preventing generation of the scratch defects while performing a polishing process.

Comparative Experiment #2:

A degree of scratch defects on a substrate generated in a process using a retainer ring in accordance with exemplary embodiments was compared to a degree of scratch defects on a substrate in a process using a conventional retainer ring. First, substrates were polished in a CMP apparatus including the conventional retainer ring of Comparative Sample #1, followed by counting the number of the scratches generated on each of the substrates. Then, substrates were polished in a CMP apparatus including the retainer ring of Sample #1, followed by counting the number of scratches generated on each of the substrates. The diameter of a maximum particle included in the slurry used in the polishing process was about 130 nm.

Figure 14:
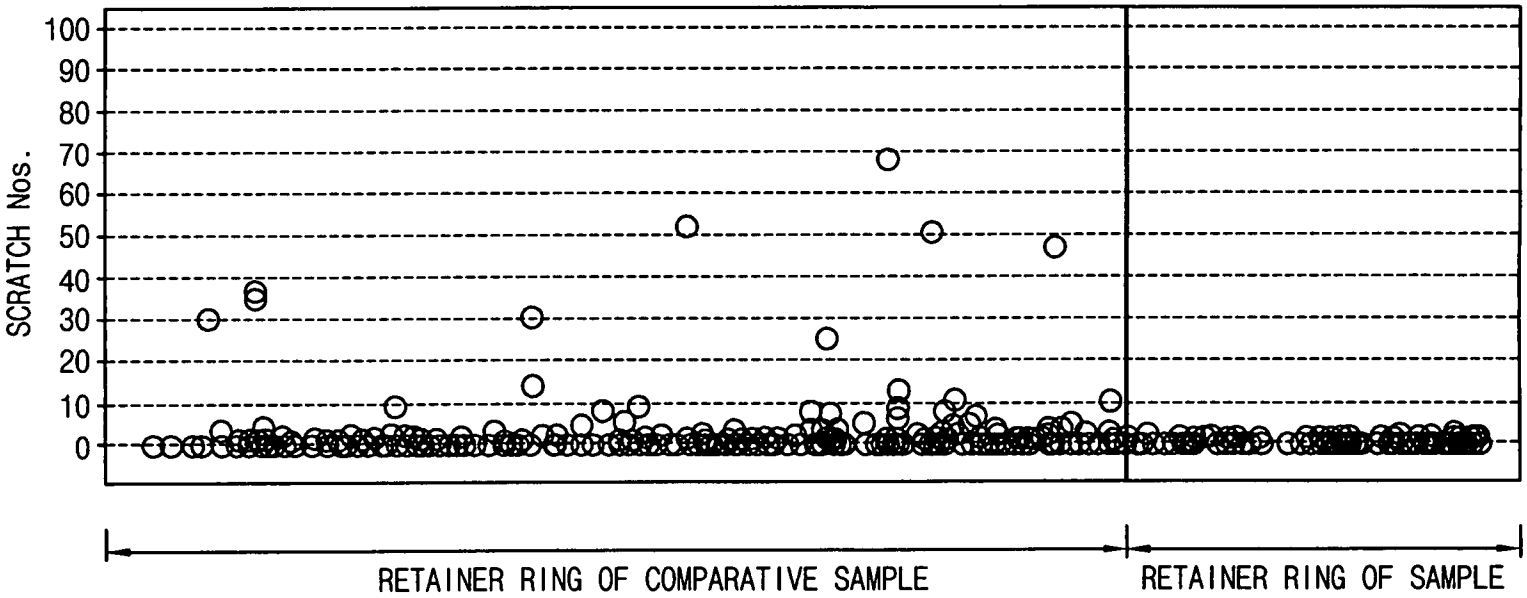
FIG. 14 is a graph illustrating numbers of scratches after performing a polishing process in accordance with different kinds of a retainer ring.

FIG. 14 is a graph illustrating numbers of scratches with respect to different kinds of retainer rings. Referring to FIG. 14, the scratch defects were generated non-periodically on the substrates after performing the polishing with respect to the substrates in the CMP apparatus including the conventional retainer ring. However, the scratch defects were rarely generated on the substrates after performing the polishing with respect to the substrates in the CMP apparatus including the retainer ring of Sample #1 in accordance with exemplary embodiments.

Therefore, according to the experiments, the scratch defects may be decreased when using a retainer ring in accordance with exemplary embodiments in a CMP apparatus. Accordingly, manufacturing yields of semiconductor devices may be improved by applying the retainer ring in a CMP apparatus.

As described above, retainer rings in accordance with exemplary embodiments may be applied to a CMP apparatus. Accordingly, contamination on a retainer ring due to slurry may be rarely generated, so scratch defects on a substrate due to solidified slurry contamination may be decreased while performing a polishing process using the CMP apparatus. Further, a manufacturing productivity of semiconductor devices formed on the substrate may be increased.

In contrast, slurry may frequently attach to a conventional retainer ring of a CMP apparatus, and then may be solidified. The solidified slurry may be separated from the retainer ring while performing a subsequent polishing process to generate scratch defects on the substrate Example embodiments have been disclosed herein, and although specific terms are employed, they are used and are to be interpreted in a generic and descriptive sense only and not for purpose of limitation. Accordingly, it will be understood by those of skill in the art that various changes in form and details may be made without departing from the spirit and scope of the present invention as set forth in the following claims.

What is claimed is:

1. A retainer ring of a chemical mechanical polishing apparatus utilizing a slurry including particles, sizes of which particles are no larger than that of a particle having a maximum size, the retainer ring comprising:

a base portion having a ring shape, the base portion including a pressurizing surface and a combining surface opposite the pressurizing surface;

slurry inflowing portions on the pressurizing surface of the base portion, the slurry inflowing portions having groove shapes; and minute grooves at least on a surface portion of the slurry inflowing portions, wherein a width of each minute groove is so dimensioned as to be smaller than ten times a diameter of the particle having the maximum size included in the slurry and is greater than a diameter of a water molecule.

2. The retainer ring as claimed in claim 1, wherein the width of each minute groove is so dimensioned as to be smaller than the diameter of the particle having the maximum size included in the slurry.

3. The retainer ring as claimed in claim 1, wherein the minute grooves are arranged in parallel to each other, the minute grooves having line shapes extending from an outer circumference to an inner circumference of the base portion.

4. The retainer ring as claimed in claim 1, wherein a distance between the minute grooves is so dimensioned as to be smaller than ten times the diameter of the particle having the maximum size included in a slurry.

5. The retainer ring as claimed in claim 4, wherein the distance between adjacent minute grooves is so dimensioned as to be smaller than the diameter of the particle having the maximum size included in the slurry.

6. The retainer ring as claimed in claim 1, wherein the slurry inflowing portions are disposed at a same distance along the base portion, the slurry inflowing portions having line shapes extending from an outer circumference to an inner circumference of the base portion.

7. The retainer ring as claimed in claim 1, wherein the minute grooves are on a surface portion of the pressurizing surface between adjacent slurry inflowing portions.

8. The retainer ring as claimed in claim 1, wherein the minute grooves are on a bottom portion and on a sidewall portion of the slurry inflowing portion of the base portion.

9. The retainer ring as claimed in claim 1, wherein the minute grooves are only on a bottom portion of the slurry inflowing portion of the base portion.

10. The retainer ring as claimed in claim 1, wherein the base portion includes engineering plastic.

11. A retainer ring of a chemical mechanical polishing apparatus utilizing a slurry including particles, sizes of which particles are no larger than that of a particle having a maximum size, the retainer ring comprising:

a base portion including a first surface and a second surface opposite each other;

slurry inflowing portions on the first surface of the base portion, the slurry inflowing portions being recesses in the first surface and being configured to pass slurry therethrough; and a plurality of minute grooves on at least a bottom portion of each slurry inflowing portion, each minute groove having a same length as a corresponding slurry inflowing portion and a smaller width than the corresponding slurry inflowing portion.

12. The retainer ring as claimed in claim 11, wherein a width of each minute groove is so dimensioned as to be smaller than a diameter of the particle having the maximum size included in the slurry, the width of the minute groove being measured along a perimeter of the base portion.

13. The retainer ring as claimed in claim 11, wherein a depth of each minute groove is smaller than a corresponding minute groove width.

14. A method of manufacturing a retainer ring utilizing a slurry including particles, sizes of which particles are no larger than that of a particle having a maximum size, the method comprising:

forming a base portion having a ring shape, the base portion including a pressurizing surface and a combining surface opposite the pressurizing surface;

forming slurry inflowing portions on the pressurizing surface of the base portion, the slurry inflowing portions having groove shapes; and forming minute grooves at least on a surface portion of the slurry inflowing portions, wherein forming the minute grooves includes forming a width of the minute grooves so dimensioned as to be smaller than ten times a diameter of the particle having the maximum size included in the slurry and greater than a diameter of a water molecule.

15. The method as claimed in claim 14, wherein forming the base portion includes:

forming a preliminary base portion having a ring shape by cutting and processing an engineering plastic; and cutting and processing a surface portion of the preliminary base portion to form the base portion.

16. The method as claimed in claim 14, wherein forming the slurry inflowing portions includes removing a portion of the pressurizing surface of the base portion.

17. The method as claimed in claim 14, wherein forming the minute grooves includes forming a distance between the minute grooves so dimensioned as to be smaller than ten times the diameter of the particle having the maximum size included in the slurry.

18. The method as claimed in claim 14, wherein forming the minute grooves includes performing a mechanical processing or a photolithography on the base portion.

* * * * *